US007661278B1

(12) United States Patent
Yang

(10) Patent No.: US 7,661,278 B1
(45) Date of Patent: Feb. 16, 2010

(54) LOCK ASSEMBLY CAPABLE OF COUNTING THE NUMBER OF TIMES OF UNLOCKING OPERATION

(76) Inventor: Yao-Kun Yang, No. 101, Lane 93, Chang Lu Road, Chang Hua City (TW)

( * ) Notice: Subject to any disclaimer, the term of this patent is extended or adjusted under 35 U.S.C. 154(b) by 0 days.

(21) Appl. No.: 12/252,627

(22) Filed: Oct. 16, 2008

(51) Int. Cl.
*E05B 39/04* (2006.01)
*E05B 67/24* (2006.01)

(52) U.S. Cl. ..... 70/38 A; 70/432; 70/437; 70/DIG. 59

(58) Field of Classification Search ..... 70/38 A, 70/38 B, 38 C, 39, 432–441, DIG. 59
See application file for complete search history.

(56) References Cited

U.S. PATENT DOCUMENTS

| | | | | | |
|---|---|---|---|---|---|
| 123,558 | A * | 2/1872 | Dopp | 70/437 |
| 137,181 | A * | 3/1873 | Cooper | 70/437 |
| 232,070 | A * | 9/1880 | Russell | 70/437 |
| 265,584 | A * | 10/1882 | Dickerman et al | 70/437 |
| 428,711 | A * | 5/1890 | Barr | 70/437 |
| 536,195 | A * | 3/1895 | Edgar | 70/437 |
| 536,196 | A * | 3/1895 | Edgar | 70/437 |
| 714,054 | A * | 11/1902 | Stebbins | 70/437 |
| 934,959 | A * | 9/1909 | Crow | 70/437 |
| 1,002,356 | A * | 9/1911 | Auerbach | 70/437 |
| 1,153,614 | A * | 9/1915 | Forsheim et al | 70/437 |
| 1,165,545 | A * | 12/1915 | Shipman | 70/437 |
| 1,168,340 | A * | 1/1916 | Shipman | 70/437 |
| 1,194,241 | A * | 8/1916 | Savage | 70/437 |
| 1,200,949 | A * | 10/1916 | Johnson | 70/437 |
| 1,248,561 | A * | 12/1917 | Shipman | 70/437 |
| 1,308,458 | A * | 7/1919 | Voight | 70/437 |
| 1,486,037 | A * | 3/1924 | Rousseau | 70/437 |
| 1,607,758 | A * | 11/1926 | Junkunc | 70/38 A |
| 2,834,195 | A * | 5/1958 | Stackhouse | 70/339 |
| 3,221,526 | A * | 12/1965 | Stackhouse | 70/437 |
| 3,789,639 | A * | 2/1974 | Canter | 70/437 |
| 4,345,447 | A * | 8/1982 | Keung et al. | 70/38 A |
| 6,708,534 | B1 * | 3/2004 | Ruan | 70/38 A |
| 7,251,967 | B2 * | 8/2007 | Yang | 70/63 |
| 2002/0046584 | A1 * | 4/2002 | Lumpkin et al. | 70/38 A |

* cited by examiner

*Primary Examiner*—Lloyd A Gall
(74) *Attorney, Agent, or Firm*—Browdy and Neimark, PLLC

(57) ABSTRACT

A lock assembly includes a housing, a shackle having a pivotal portion, which is disposed in the housing and axially moveable and pivotable, and a free end insertable into a top hole of the housing, and a latch movably disposed in the housing and engagable with the pivotal portion or the free end of the shackle. A key controlled lock unit is disposed in the housing and has a plug rotatable between an unlocked position where the latch can be disengaged from the shackle by a first arm, and a counter can be started by a second arm, and a locked position where the latch is engaged with the shackle.

2 Claims, 2 Drawing Sheets

LOCK ASSEMBLY CAPABLE OF COUNTING THE NUMBER OF TIMES OF UNLOCKING OPERATION

BACKGROUND OF THE INVENTION

1. Field of the Invention

The present invention relates generally to locks and more specifically, to a lock assembly including a counter to count the number of times that the lock assembly is unlocked.

2. Description of the Related Art

A conventional key controlled lock unit generally includes a housing, a plug rotatably disposed in the housing, and a shackle controlled by the plug. When a key is inserted into a keyhole of the plug and turned, the shackle can be pulled upwards to encompass a thing that is to be secured by the key controlled lock unit, such as a door, drawer, or container, thereby restricting access to the area or the property enclosed.

The key controlled lock unit can prevent people who doesn't have the key from unlocking it, but can't keep people who is capable of acquiring the key from unlocking it, such as the home care for the elderly, the servant, or the storekeeper. If these key holders unlock the key controlled lock unit without authorization to steal the valuables from the drawer, the room, or the storehouse and then lock it, the family members or other storekeepers may be aware of something stolen after a long time, or don't even know about the facts. Under this circumstance, these key holders may steal the valuables over and over again, thereby causing huge loss for the family or the storehouse.

SUMMARY OF THE INVENTION

The present invention has been accomplished in view of the above-noted circumstances. It is therefore one objective of the present invention to provide a lock assembly, which has a counter to count the number of times of unlocking operation, thereby preventing the lock assembly from being unlocked without authorization.

To achieve this objective of the present invention, the lock assembly comprises a housing, a shackle having a pivotal portion, which passes through a first top hole of the housing into an accommodation chamber of the housing and is axially moveable and pivotable relative to the housing, and a hook portion integrally connected with the pivotal portion and provided with a free end insertable into a second top hole of the housing by means of the axial movement of the pivotal portion, at least one latch movably disposed in the accommodation chamber of the housing and engagable with an insertion groove provided by at least one of the pivotal portion and the free end of the hook portion of the shackle, a counter disposed in the accommodation chamber of the housing, and a key controlled lock unit disposed in the accommodation chamber of the housing and having a plug disposed in a plug casing and rotatable between an unlocked position and a locked position.

When the plug is located at the unlocked position, a first arm, which extends from the plug casing, is located at a first place enabling a disengaging movement of the latch from the insertion groove such that the pivotal portion of the shackle can be axially moved to drive the free end of the hook portion of the shackle to leave the second top hole, and a second arm, which extends from the plug casing, can start the counter. When the plug is located at the locked position, the first arm is located at a second place prohibiting the disengaging movement of the latch from the insertion groove such that the pivotal portion of the shackle can't be axially moved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
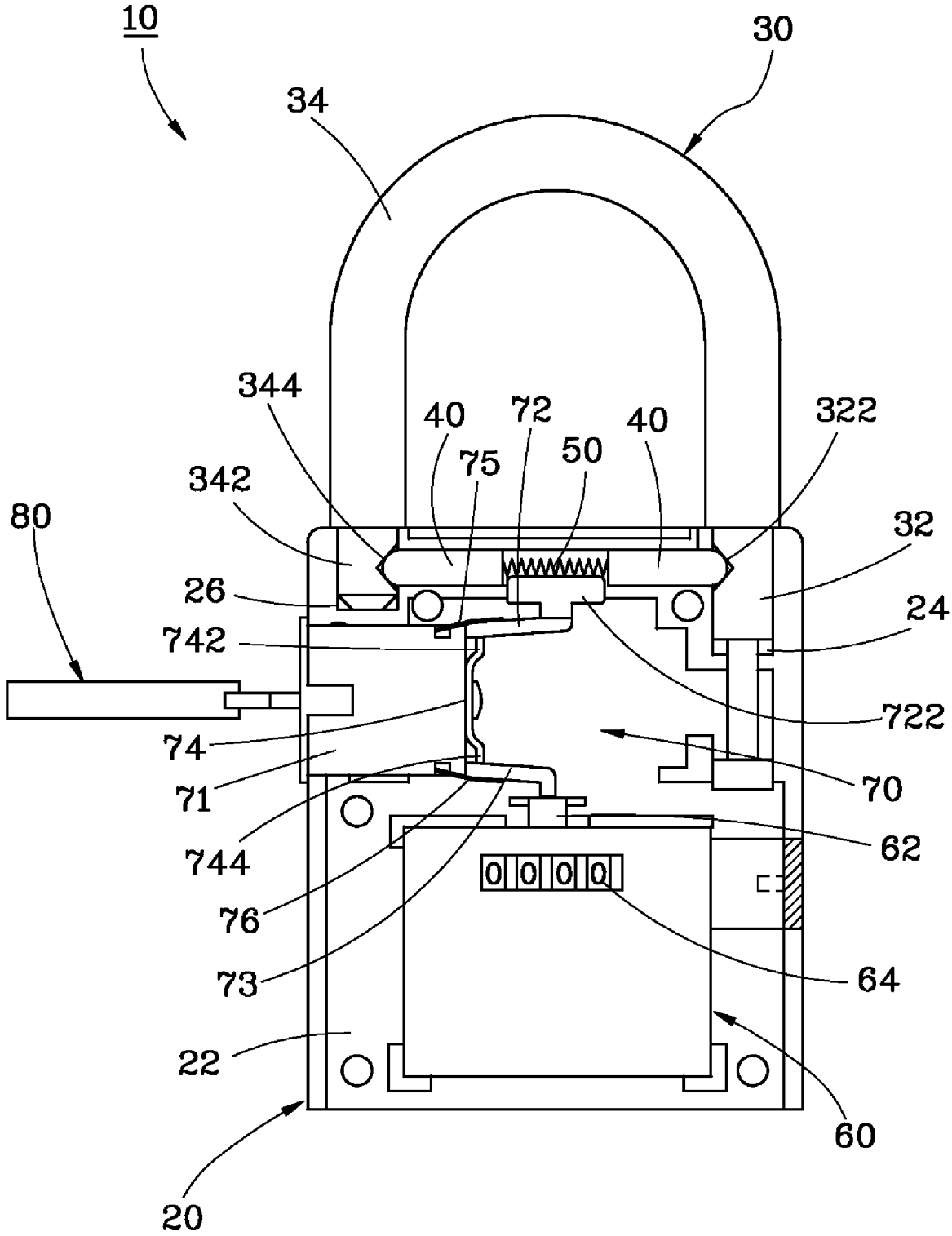
FIG. 1 is a cutaway schematic drawing of a lock assembly according to a preferred embodiment of the present invention, showing the plug is located at the locked position.

As shown in FIG. 1, a lock assembly 10 in accordance with a preferred embodiment of the present invention comprises a housing 20, a shackle 30, two latches 40, an elastic member 50, a counter 60, and a key controlled lock unit 70.

The housing 20 has an accommodation chamber 22, a first top hole 24 in communication with the accommodation chamber 22, and a second top hole 26 in communication with the accommodation chamber 22.

The shackle 30 has a pivotal portion 32 and a hook portion 34 integrally connected with the pivotal portion 32. The pivotal portion 32 passes through the first top hole 24 of the housing 20 into the accommodation chamber 22 of the housing 20 and is axially moveable and pivotable relative to the housing 20. The hook portion 34 is provided with a free end 342 insertable into the second top hole 26 of the housing 20 by means of the axial movement of the pivotal portion 32. The pivotal portion 32 and the free end 342 of the hook portion 34 each have an insertion groove 322 or 344.

The latches 40 are disposed in the accommodation chamber 22 of the housing 20 and horizontally moveable relative to the housing 20 such that the latches 40 can be engaged with or disengaged from the insertion grooves 322 and 344 respectively.

The elastic member 50 is disposed between the latches 40, having two ends respectively stopped against the latches 40 for providing an elastic force to push the latches 40 toward the insertion grooves 322 and 344.

The counter 60 is mounted in the accommodation chamber 22 of the housing 20, having a switch 62 and a plurality of counting wheels 64 connected with the switch 62. When an external force presses and releases the switch 62, the switch 62 can drive the counting wheels 64 to rotate for counting the number of times that the switch 62 is pressed. Since the counter 60 is a well known prior art that can be easily accomplished by a person skill in the art or can be easily obtained from market or manufacturer, the detailed structure thereof won't be necessarily described hereunder.

The key controlled lock unit 70 has a plug 71*a* rotatably disposed in a plug casing 71 which is mounted in the accommodation chamber 22 of the housing 20 and provided with a keyhole (not shown) for insertion of a key 80 so as to be rotatable by the key 80 between an unlocked position and a locked position, a first arm 72 extending from a top of the plug casing 71 and having a block end 722, a second arm 73 extending from a bottom of the plug casing 71, a driving member 74 connected with the plug 71*a* so as to be rotatable along with the plug casing 71 and located between the first arm 72 and the second aim 73 and provided with a first driving portion 742 and a second driving portion 744, a first elastic strip 75 mounted on the plug casing 71 and stopped against the first arm 72 for enabling the first arm 72 to be biased away from the latches 40, and a second elastic strip 76 mounted on the plug casing 71 and stopped against the second arm 72 for enabling the second arm 72 to be biased away from the counter 60.

Figure 2:
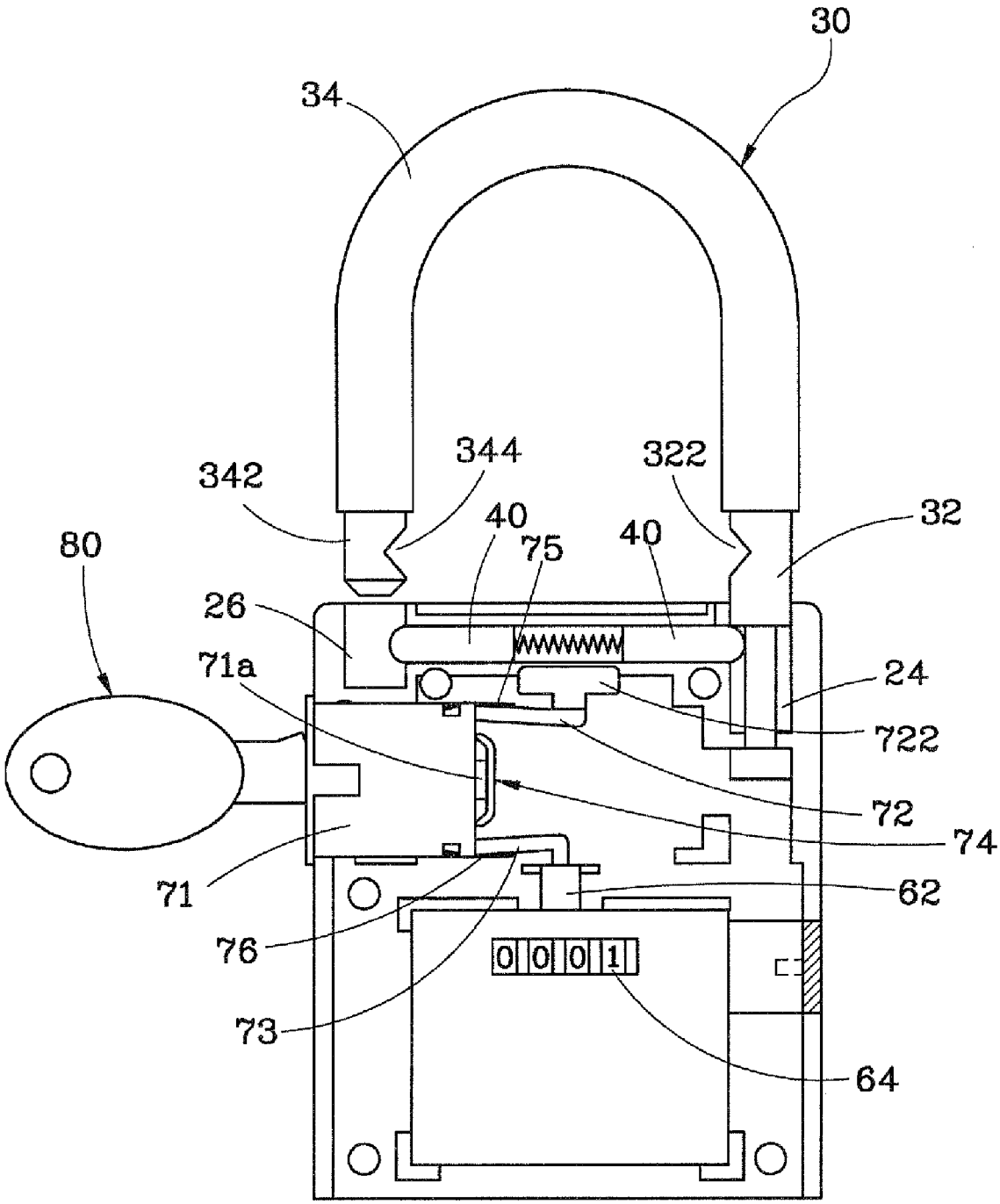
FIG. 2 is a cutaway schematic drawing of the lock assembly according to the preferred embodiment of the present invention, showing the plug is located at the unlocked position.

When the plug 71*a* is located at the locked position, as shown in FIG. 1, the first driving portion 742 of the driving member 74 pushes the first arm 72 to force the block end 722 of the first arm 72 to be situated at a space defined between the latches 40 such that the latches 40 are engaged with the insertion groove 322 of the pivotal portion 32 and the insertion groove 344 of the free end 342 of the hook portion 34 of the shackle 30, resulting in that the shackle 30 can't be pulled upwards. At the same time, the second driving portion 744 of the driving member 74 pushes the second arm 73 to force the second arm 73 to press the switch 62 of the counter 60. When the plug 71*a* is located at the unlocked position, as shown in FIG. 2, the first driving portion 742 and the second driving portion 744 of the driving member 74 leave the first arm 72 and the second arm 73 respectively such that the first arm 72 is pushed by the first elastic strip 75 to force the block end 722 to leave the space defined between the latches 40, thereby allowing the latches 40 to be disengaged from the insertion grooves 322 and 344 and enabling the shackle 30 to be pulled upwards. Simultaneously, the second arm 73 is pushed by the second elastic strip 76 to release the switch 62 of the counter 60 for starting the counter 60.

By means of aforesaid design, when the plug 71*a* is located at the locked position, as shown in FIG. 1, the shackle 30 can't be pulled upwards due to the restriction of the latches 40, and the counter 60 can't be actuated because of the pressure of the second arm 73.

When somebody uses the key 80 to drive the plug 71*a* to rotate to the unlocked position with or without authorization, as shown in FIG. 2, the latches 40 can be movable relative to the housing 20 to be disengaged from the insertion grooves 322 and 344 because the separation of the block end 722 of the first arm 72 and the latches 40, such that the shackle 30 can be pulled upwards to unlock the lock assembly 10. At the time of unlocking the lock assembly 10, the switch 62 of the counter 60 will drive the counting wheels 64 to rotate because of the release of the second arm 73, thereby counting the number of times that the lock assembly 10 is unlocked.

As a result, even though the lock assembly 10 is locked again, the counter 60 won't return to zero such that a user of the lock assembly 10 of the present invention can be immediately aware that the lock assembly 10 had been unlocked by someone through the counter 60.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lock assembly comprising:

a housing having an accommodation chamber, a first top hole in communication with said accommodation chamber, and a second top hole in communication with said accommodation chamber;

a shackle having a pivotal portion, which passes through said first top hole into said accommodation chamber and is axially moveable and pivotable relative to said housing, and a hook portion integrally connected with said pivotal portion and provided with a free end insertable into said second top hole by means of the axial movement of said pivotal portion, at least one of said pivotal portion and said free end of said hook portion having an insertion groove;

at least one latch movably disposed in said accommodation chamber of said housing and engagable with said insertion groove;

a counter disposed in said accommodation chamber of said housing; and a key controlled lock unit disposed in said accommodation chamber of said housing and having a plug disposed in a plug casing and rotatable between an unlocked position where a first arm, which extends from said plug casing, is located at a first place enabling a disengaging movement of said latch from said insertion groove such that said pivotal portion of said shackle can be axially moved to allow said free end of said hook portion of said shackle to leave said second top hole, and a second arm, which extends from said plug casing, can start said counter, and a locked position where said first arm is located at a second place prohibiting the disengaging movement of said latch from said insertion groove such that said pivotal portion of said shackle cannot be axially moved;

wherein each of said pivotal portion and said free end of said hook portion has one said insertion groove;

wherein said at least one latch comprises two latches respectively engaged with said insertion grooves of said pivotal portion and said free end of said hook portion, and an elastic member having two ends respectively stopped against said latches; and wherein said first arm of said key controlled lock unit has a block end, which leaves a space defined between said latches such that said latches are movable relative to said housing when said plug is located at said unlocked position, and blocks said space defined between said latches such that said latches are immovable relative to said housing when said plug is located at said locked position.

2. A lock assembly comprising:

a housing having an accommodation chamber, a first top hole in communication with said accommodation chamber, and a second top hole in communication with said accommodation chamber;

a shackle having a pivotal portion, which passes through said first top hole into said accommodation chamber and is axially moveable and pivotable relative to said housing, and a hook portion integrally connected with said pivotal portion and provided with a free end insertable into said second top hole by means of the axial movement of said pivotal portion, at least one of said pivotal portion and said free end of said hook portion having an insertion groove;

at least one latch movably disposed in said accommodation chamber of said housing and engagable with said insertion groove;

a counter disposed in said accommodation chamber of said housing; and a key controlled lock unit disposed in said accommodation chamber of said housing and having a plug disposed in a plug casing and rotatable between an unlocked position where a first arm, which extends from said plug casing, is located at a first place enabling a disengaging movement of said latch from said insertion groove such that said pivotal portion of said shackle can be axially moved to allow said free end of said hook portion of said shackle to leave said second top hole, and a second arm, which extends from said plug casing, can actuate said counter, and a locked position where said first arm is located at a second place prohibiting the disengaging movement of said latch from said insertion groove such that said pivotal portion of said shackle cannot be axially moved;

wherein said key controlled lock unit further comprises a first elastic strip mounted on said plug casing, a second elastic strip mounted on said plug casing, and a driving member connected with said plug and provided with a first driving portion, which leaves said first arm to enable said first arm to be forced by said first elastic strip to move to the first place when said plug is located at said unlocked position, and pushes said first arm to move to the second place when said plug is located at said locked position, and a second driving portion, which leaves said second arm to enable said second arm to be forced by said second elastic strip to release a switch of said counter when said plug is located at said unlocked position, and pushes said second arm to press said switch of said counter when said plug is located at said locked position.

* * * * *